US007367596B2

(12) United States Patent
Leung

(10) Patent No.: US 7,367,596 B2
(45) Date of Patent: May 6, 2008

(54) GROUND LOCK FITTING

(76) Inventor: Chi Pang Leung, No. 6, 83 Electric Road, Causeway Bay (HK)

( * ) Notice: Subject to any disclaimer, the term of this patent is extended or adjusted under 35 U.S.C. 154(b) by 0 days.

(21) Appl. No.: 11/326,387

(22) Filed: Jan. 6, 2006

(65) Prior Publication Data

US 2007/0079638 A1 Apr. 12, 2007

(30) Foreign Application Priority Data

Oct. 10, 2005 (HK) ..... 05108950

(51) Int. Cl.
*E05C 19/08* (2006.01)
*E05C 19/16* (2006.01)

(52) U.S. Cl. ..... 292/281; 292/148; 292/150; 292/183; 292/251.5; 292/283; 292/DIG. 4; 292/DIG. 15; 292/DIG. 29

(58) Field of Classification Search ..... 292/148, 292/150, 183, 184, 251.5, 281, 283, 332, 292/333, DIG. 4, DIG. 15, DIG. 29; 16/82; 160/290.1; 49/49, 478.1, 394, 449; 70/95, 70/276

See application file for complete search history.

(56) References Cited

U.S. PATENT DOCUMENTS 2,475,226 A * 7/1949 Ellis ..... 24/303
2,497,697 A * 2/1950 Smith ..... 292/74
2,853,331 A * 9/1958 Teetor ..... 292/251.5
2,929,647 A * 3/1960 Gladstone ..... 292/60
3,258,285 A * 6/1966 Smith ..... 292/251.5
3,492,037 A * 1/1970 Hutchinson ..... 292/251.5
3,563,586 A * 2/1971 Creamer et al. ..... 292/144
3,584,485 A * 6/1971 Peterson ..... 70/276
3,736,779 A * 6/1973 Pratt ..... 70/276
3,744,833 A * 7/1973 Berducone ..... 292/251.5
4,227,726 A * 10/1980 Sorimachi ..... 292/251.5
4,249,761 A * 2/1981 Nishimura ..... 292/251.5
4,343,500 A * 8/1982 Steiner ..... 292/175
4,601,502 A * 7/1986 Van Dyke ..... 292/252
4,702,038 A * 10/1987 Frey ..... 49/478.1
4,919,563 A * 4/1990 Stice ..... 404/6
5,018,241 A * 5/1991 Baines ..... 16/82
5,365,694 A * 11/1994 Macaluso ..... 49/49
5,380,053 A * 1/1995 Saino ..... 292/144
5,395,143 A * 3/1995 Chesterton ..... 292/57
5,819,471 A * 10/1998 Koerber ..... 49/49

(Continued)

FOREIGN PATENT DOCUMENTS

CN ZL 01214242.5 12/2001

*Primary Examiner*—Carlos Lugo
(74) *Attorney, Agent, or Firm*—Rabin & Berdo, P.C.

(57) ABSTRACT

A ground lock fitting comprises: an upper cover comprises a top surface and an upper sidewall, wherein a guiding hole is provided on the top surface and a thread is provided on the upper sidewall; a lower cover comprises a base surface and a lower sidewall, wherein a mounting hole is provided on the base surface; the upper cover is connected with the lower cover to form a chamber in which a locking bar comprising a mainbody and a stopper attached thereunder is disposed; and a magnetized portion is provided on top of the mainbody in which a locking hole is provided. The ground lock fitting is hidden from view, hard to break open and convenient to use such that it can be widely used in rolling shutter gates for stores and the like.

8 Claims, 3 Drawing Sheets

U.S. PATENT DOCUMENTS 6,151,754 A * 11/2000 Chen ..... 16/85
6,289,633 B1 * 9/2001 Lowe ..... 49/49
6,321,411 B1 * 11/2001 Ikejiri et al. ..... 16/82
6,409,419 B1 * 6/2002 Hernandez ..... 404/6
6,786,010 B1 * 9/2004 McNabb ..... 52/60

* cited by examiner

GROUND LOCK FITTING

FIELD OF THE INVENTION

The present invention relates to a gate lock fitting, particularly a ground lock fitting for use in a rolling shutter gate of a store and the like.

BACKGROUND OF THE INVENTION

For convenience of the user, a gate lock is usually mounted outside the existing rolling shutter gate, and a steel column used as the lock bracket must be embedded in the ground outside the gate. If the steel column is embedded in the stoop or in the sill, there is not only an aesthetical impact on the stoop but also increases chances of being stumbled over it and causing bodily injury to the people passing by. If the steel column is embedded beyond the stoop, then it must be extended to reach the sill. In this case, the joint between the steel column and the stoop is exposed and such an extended steel column will render the joint to be easily broken open by a picklock. Therefore the rolling shutter gate is rather easy to break open and dismantle, thereby causing a potential safety issue thereof. Chinese Patent No. 01214242.5 disclosed a built-in theft-proof fitting for the rolling shutter gate. The technical scheme adopted in the patent is to place the gate lock inside the gate so as to minimize the risk of being pried and enhance the security thereof. However, the locking and unlocking operations thereof have to be inconveniently carried out by the user in a narrow space between the lower edge of the rolling shutter gate and the sill thereunder. It has thus been a technical problem, which puzzled designers for a long time, in making a rolling shutter gate having a locking means that is convenient to use, more hidden from view and difficult to break open.

SUMMARY OF THE INVENTION

It is therefore an object of the present invention to eliminate the foregoing drawbacks in the prior art and provide a ground lock fitting which is much more hidden from view, difficult to break open and convenient to use.

In order to realize the above object, the present invention provides a ground lock fitting comprises:

an upper cover comprises a top surface and an upper sidewall extends downwardly from the periphery of the top surface whereby forming a hollow cavity, wherein a guiding hole is provided on the top surface and a thread is provided on the upper sidewall;

a lower cover comprises a base surface and a lower sidewall extends upwardly from the periphery of the base surface whereby forming a hollow cavity, wherein a mounting hole is provided on the base surface and a counterpart thread of the thread on the upper sidewall is provided on the lower sidewall; the upper cover is connected in a threading manner with the lower cover, thereby forming a chamber in the lock fitting; and a locking bar comprises a mainbody and a stopper attached thereunder, wherein the locking bar is disposed in the chamber, and the upper portion of the mainbody is within the guiding hole of the top surface or being protruded through the guiding hole; and a magnetized portion is provided on top of the upper portion of the mainbody in which a locking hole is provided.

As compared with the prior art, the ground lock fitting of the present invention is embedded in the sill outside the gate.

While in use, it will be covered by the lower edge of the rolling shutter gate, thereby it is hard to break open; and the whole ground lock fitting is concealed underground and hidden from view while not in use, thereby it has no aesthetical effect and is very secure. Further, the locking and unlocking operations thereof can be conveniently carried out by the user as the fitting is mounted outside the gate.

Preferably, the fitting further comprises a lockbody having a cavity defined by its enclosed sidewall, on which counterpart threads of the threads on the upper sidewall and the lower sidewall are provided, wherein the lockbody respectively connects in a threading manner with the upper cover and the lower cover, thereby forming a chamber in the lockbody.

Preferably, the locking bar is made of steel, with which the magnetized portion is integrated. The magnetized portion is a magnet or a magnetic substance arranged on top of the mainbody of the locking bar and the magnet or magnetic substance is mounted in an adhering manner or a welding manner on top of the mainbody.

Preferably, the upper cover has a female thread and the lower cover has a male thread, or the upper cover has a male thread and the lower cover has a female thread so as to be connected in a threading manner with each other.

Preferably, the upper cover as well as the lower cover both have a male thread and the lockbody has a female thread, or vice versa.

Preferably, a rubber block is adhered to the bottom surface of the stopper in contact with the lower cover and one or more recessed portions or through holes are further provided on the top surface of the upper cover as a force applying/acting point thereof for use with the mounting or dismounting tools.

For the better understanding of the present invention, the teachings, specific configurations and the technical effects thereof will be described in further details below with reference to the drawings.

DETAILED DESCRIPTION OF THE INVENTION

Figure 1:
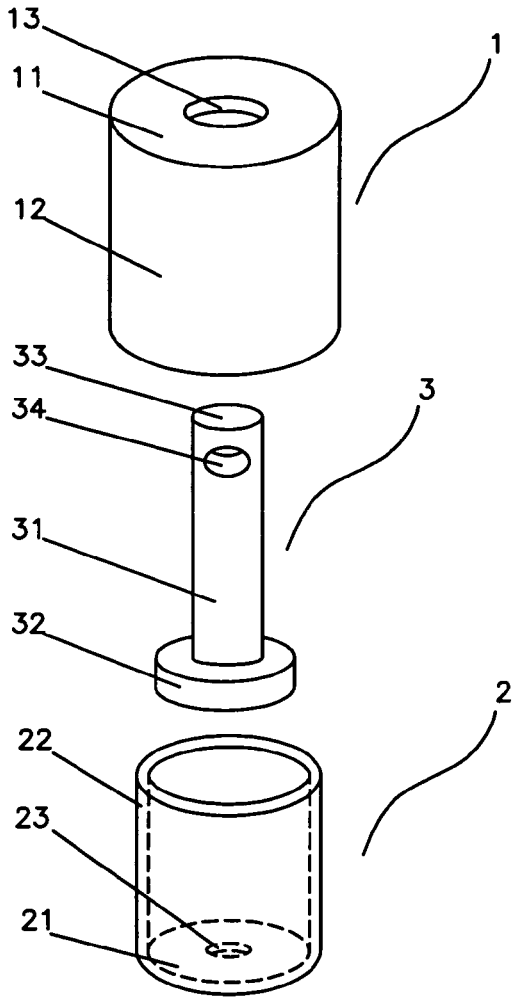
FIG. 1 is a stereoscopic exploded view of an embodiment of the present invention.

As is shown in FIG. 1, the present invention comprises: an upper cover 1 comprises a top surface 11 and an upper sidewall 12 extends downwardly from the periphery of the top surface thereby forming a hollow cavity, wherein a guiding hole 13 is provided on the top surface 11 and a female thread is provided on the upper sidewall 12; a lower cover 2 comprises a base surface 21 and a lower sidewall 22 extends upwardly from the periphery of the base surface thereby forming a hollow cavity, wherein a mounting hole 23 is provided on the base surface 21 and a male thread (not shown) matched with the female thread on the upper sidewall 12 is provided on the lower sidewall 22; the upper cover 1 is connected in a threading manner with the lower cover 2 enclosed within. The present invention also comprises a locking bar 3, which comprises a mainbody 31 and a stopper 32 attached thereunder, wherein a magnetized portion 33 is provided on top of the upper portion of the mainbody 31 in which a locking hole 34 is provided. In this embodiment, the mainbody 31 is made of steel, with which the magnetized portion 33 is integrated.

Figure 2:
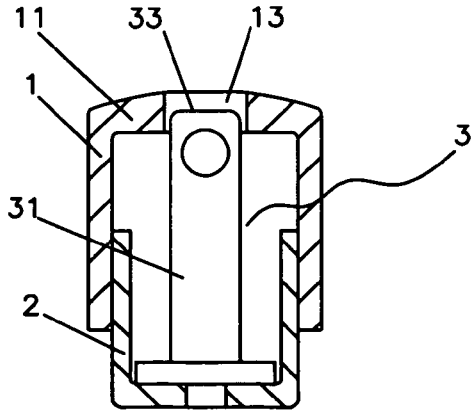
FIG. 2 is a sectional view of the assembled embodiment shown in FIG. 1.

As shown in FIG. 2, the upper cover 1 is connected in a threading manner with the lower cover 2, thereby forming a chamber in the lock fitting, and the locking bar 3 is disposed in the chamber, and the upper portion (the magnetized portion 33) of the mainbody 31 is within the guiding hole 13 of the top surface 11.

Figure 3:
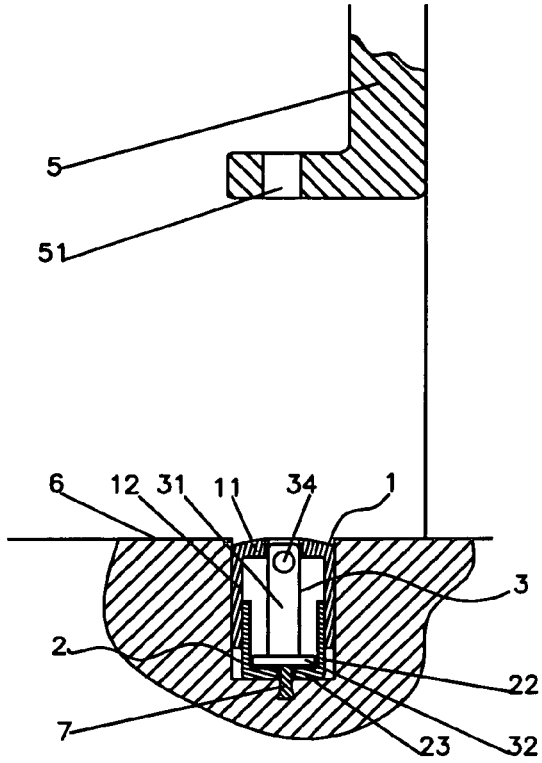
FIG. 3 is a schematic view of the assembled embodiment of FIG. 2 in a ready to use state.

As shown in FIG. 3, a bore for mounting is firstly drilled into the sill outside the gate at a position corresponds to the through hole 51 in the lower edge of the rolling shutter gate 5. The diameter of the bore is larger than the outer diameter of the upper cover 1, and the depth is equal to or slightly larger than the overall height of the assembled ground lock fitting. Then the lower cover 2, with its lower sidewall 22 being situated above the base surface 21, can be fixed into the bore by means of the mounting hole 23 and a connection bolt 7, such as an expansion bolt. The locking bar 3, with its stopper 32 being faced downwardly, is placed into the hollow cavity of the lower cover 2, and then the upper cover 1 is connected in a threading manner with the lower cover 2 until the upper portion of the mainbody 31 of the locking bar 3 is kept within the guiding hole 13 of the top surface 11. Then the ground lock fitting is completely fixed into the sill, thereby it is hidden from view and ready to use.

Figure 4:
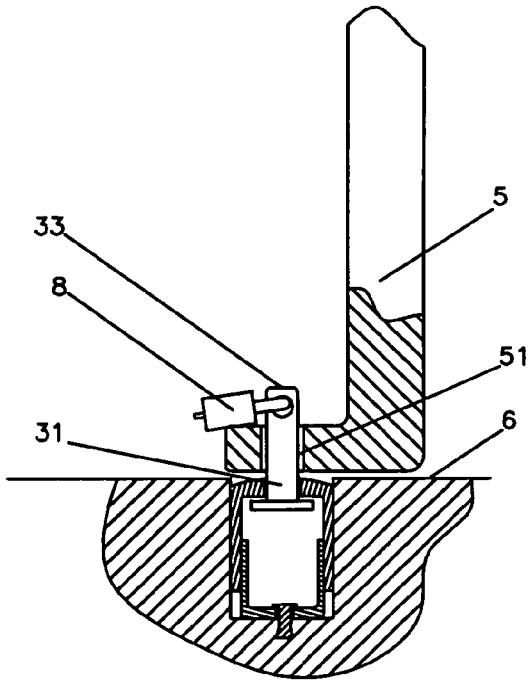
FIG. 4 is a schematic view of the assembled embodiment of FIG. 2 in use.

Referring to FIG. 4, an embodiment of the present invention in use. The rolling shutter gate 5 will be firstly pulled down toward the sill before locking it, thereby the through hole 51 in the lower edge of which can be aligned with the locking bar 3. Then a metallic object, for example, a coin or a key etc can be placed over the magnetized portion 33 in the upper portion of the locking bar 3, for example, it can be placed just above the top end of the through hole 51, and then the locking bar will be picked up from the chamber by the magnetic force thereof, thereby the upper portion of the locking bar 3 pass through the through hole 51 in the lower edge of the rolling shutter gate 5 and the locking hole 34 thereof is exposed above the top end of the through hole 51. In this case the locking bar 3 can be used as a lock catch, that is, the gate 5 can be conveniently locked by putting on a padlock 8 through the locking hole 34 thereof.

Once the padlock 8 is unlocked and taken off, the locking bar 3 drops into the chamber under the action of the gravity force and to be concealed in the chamber below the plane surface of the sill 6, thereby the rolling shutter gate 5 can be conveniently pulled up and opened.

Alternatively, a male thread is provided on the upper cover 1 and a female thread is provided on the lower cover 2, whereby the lower cover 2 is connected in a threading manner with the upper cover 1 enclosed within.

Figure 5:
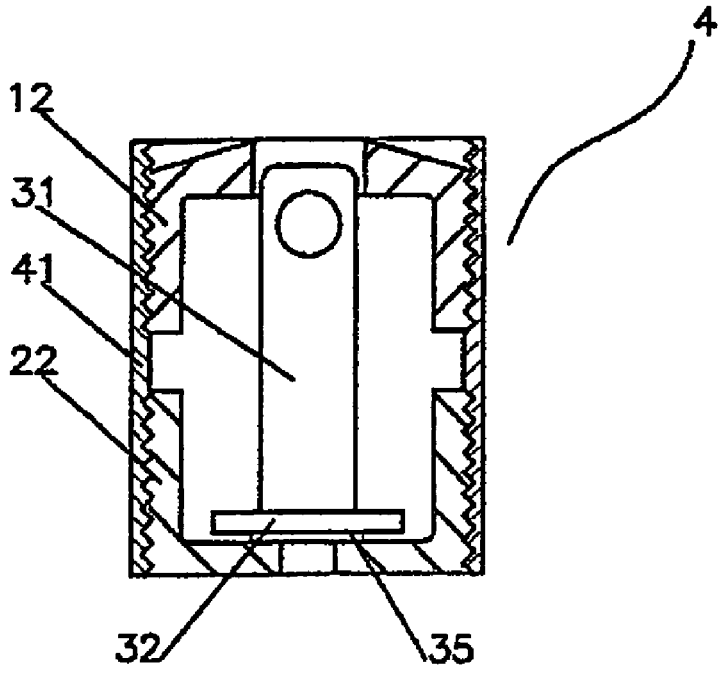
FIG. 5 is a sectional view of another assembled embodiment of the present invention.

Referring to FIG. 5, yet another embodiment of the present invention, wherein it further comprises a lockbody 4 having a cavity defined by its enclosed sidewall 41, on which counterpart threads (not shown) of the threads on the upper sidewall 12 and the lower sidewall 22 are provided; the lockbody 4 respectively connects in a threading manner with the upper cover 1 and the lower cover 2, thereby forming a chamber in the lockbody. Preferably, a male thread is provided on each of the upper cover 1 and the lower cover 2, and female threads are provided on the lockbody 4 so as to be connected in a threading manner with the upper cover 1 and the lower cover 2 enclosed therein. Obviously, it will be apparent to those skill in the art that the lockbody 4 can be connected in other well-known manners with the upper cover 1 and the lower cover 2. For example, a female thread can be respectively provided on the upper cover 1 and the lower cover 2, and then male threads can be provided on the lockbody 4 so as to be connected in a threading manner with each other Referring to FIG. 2 yet once more, the overall height of the locking bar 3 shall be long enough for making the uppermost surface of the mainbody 31 to be above the opposite side of the top surface 11 of the upper cover 1 while it is not in use, thereby the locking bar can be guided by the guiding hole 13 and moved up and down inside the chamber thereof. The upper portion is preferably below the top surface 11, or else it can be slightly above the top surface 11 of the upper cover 1 but should not exceed the plane surface of the sill 6 such that the whole lock fitting can be concealed in the sill. The fitting is thus convenient to use, hard to break open and hidden from view such that the people passing by will not stumble over it.

The magnetized portion on top of the locking bar 3 can be realized in many ways, one of which is to magnetize the upper portion of the mainbody 31 (shown in FIG. 2), or else it can be formed by adhering and/or soldering a magnet or a magnetic substance onto the top of the mainbody 31.

The locking bar 3 can be in a shape of cylinder, column with circular base plate, elliptical cylinder, polygonal column or the like.

A rubber block 35 is adhered to the bottom surface of the stopper 32 in contact with the base surface 21 of the lower cover 2, thereby acting as an absorber of the locking bar 3 to minimize the impact and noise when the bar 3 falls down onto the base surface 21 after the user unlocks and removes the padlock.

Figure 6:
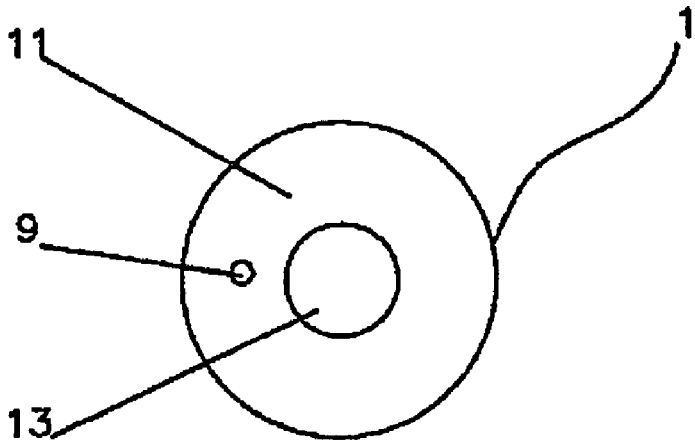
FIG. 6 is a top view of the upper cover of another embodiment of the present invention.

Referring to FIG. 6, the top surface 11 of the upper cover 1 can further comprises one or more recessed portions 9 or through holes (only one is shown) acting as a fore applying point for use in the mounting or dismounting of the upper cover 1 with a relevant tool or mounting jig. The recessed portions can be of various shapes, such as circular (as shown) or irregular shape. Preferably, two or four recessed portions 9 can be arranged on the upper cover 1 in a symmetrical way.

In summing up, it is understood that present invention is not limited to above embodiments, and many corresponding modifications as well as variations are also possible and can be made by those skill in the art as according to the teachings of the present invention, while such modifications and variations fall into the scope of the claims of the present invention.

What is claimed is:

1. A ground lock fitting for locking a gate that comprises a bottom surface with a through hole, the ground lock fitting comprising:

an upper cover comprising a top surface and an upper sidewall extending downwardly from the periphery of the top surface thereby forming a hollow cavity, wherein a guiding hole is provided on the top surface and a thread is provided on the upper sidewall;

a lower cover comprising a base surface and a lower sidewall extending upwardly from the periphery of the base surface thereby forming a hollow cavity, wherein a mounting hole is provided on the base surface and a thread is provided on the lower sidewall;

a locking bar comprising a main body and a stopper attached thereunder, wherein the upper portion of the main body is within the guiding hole of the top surface or being protruded through the guiding hole; and a magnetized portion is provided on top of the upper portion of the main body in which a locking hole is provided; and a lock body having a cavity defined by its enclosed sidewall, on which counterpart threads of the threads on the upper sidewall and the lower sidewall are provided, wherein the lock body respectively connects in a threading manner with the upper cover and the lower cover, thereby forming a chamber in the lock body and the locking bar is disposed in the chamber, wherein when the through hole of the gate is aligned with the locking bar, the locking bar is capable of moving upwardly and through the through hole of the gate, by means of the attraction of a metallic body placed over the top end of the through hole so that the locking bar can pass through the through hole and accepts the insertion of a locking member through the locking hole to lock in place the gate.

2. A ground lock fitting according to claim 1, wherein the magnetized portion is a magnet or a magnetic substance arranged on top of the main body of the locking bar.

3. A ground lock fitting according to claim 2, wherein the magnet or magnetic substance is adhered or welded on top of the main body.

4. A ground lock fitting according to claim 1, wherein the upper cover as well as the lower cover both have a male thread and the lock body has a female thread, or vice versa, so as to be connected in a threading manner with each other.

5. A ground lock fitting according to claim 1, wherein a rubber block is adhered to the bottom surface of the stopper in contact with the lower cover.

6. A ground lock fitting according to claim 1, wherein one or more recessed portions or through holes are further provided on the top surface of the upper cover.

7. A ground lock fitting for locking a gate that comprises a bottom surface with a through hole, the ground lock fitting comprising:

an upper cover comprising a top surface and an upper sidewall extending downwardly from the periphery of the top surface thereby forming a hollow cavity, wherein a guiding hole is provided on the top surface and a thread is provided on the upper sidewall;

a lower cover comprising a base surface and a lower sidewall extending upwardly from the periphery of the base surface thereby forming a hollow cavity, wherein a mounting hole is provided on the base surface and a thread is provided on the lower sidewall;

a locking bar comprising a main body and a stopper attached thereunder, wherein the upper portion of the main body is within the guiding hole of the top surface or being protruded through the guiding hole; and a magnetized portion is provided on top of the upper portion of the main body in which a locking hole is provided; and a lock body having a cavity defined by its enclosed sidewall, on which counterpart threads of the threads on the upper sidewall and the lower sidewall are provided, wherein the lock body respectively connects in a threading manner with the upper cover and the lower cover, thereby forming a chamber in the lock body and the locking bar is disposed in the chamber;

wherein the locking bar is made of steel, with which the magnetized portion is integrated, wherein when the through hole of the pate is aligned with the locking bar, the locking bar is capable of moving upwardly and through the through hole of the gate, by means of the attraction of a metallic body placed over the top end of the through hole so that the locking bar can pass through the through hole and accepts the insertion of a locking member through the locking hole to lock in place the gate.

8. A ground lock fitting for locking a gate that comprises a bottom surface with a through hole, the ground lock fitting comprising:

an upper cover comprising a top surface, and a first sidewall extending downwardly from a periphery of the top surface, a guiding hole being provided in the top surface;

a lower cover comprising a base surface, and a second sidewall extending upwardly from a periphery of the base surface, a mounting hole being provided in the base surface;

a locking bar comprising a main body having a locking hole extending transversely therethrough, the main body being disposed within the guiding hole of the upper cover, the locking bar further having a stopper attached to a bottom of the main body, an uppermost portion of the locking bar being a magnetized portion, the locking bar being movable in a direction perpendicular to an extending direction of the locking hole, and to a first position in which the locking hole is disposed above the top surface of the upper cover, and to a second position in which the uppermost portion of the locking bar is disposed below the top surface of the upper cover; and a lock body having a sidewall with threads thereon, with which counterpart threads formed on the first sidewall and the second sidewall threadably engage, thereby forming a chamber in the lock body, with the locking bar being disposed in the chamber, wherein when the through hole of the gate is aligned with the locking bar, the locking bar is capable of moving upwardly and through the through hole of the gate, by means of the attraction of a metallic body placed over the top end of the through hole so that the locking bar can pass through the through hole and accepts the insertion of a locking member through the locking hole to lock in place the gate.

* * * * *